US005884906A

United States Patent [19]

Morse

[11] Patent Number: 5,884,906

[45] Date of Patent: Mar. 23, 1999

[54] HYDRAULICALLY COMPENSATING JAW FOR HOLDING MULTIPLE WORK PIECES

[76] Inventor: Loren Morse, 7925 SW. 69th Ave., Portland, Oreg. 97223

[21] Appl. No.: 543,338

[22] Filed: Oct. 16, 1995

[51] Int. Cl.[6] ..... B25B 5/16

[52] U.S. Cl. ..... 269/266; 269/267

[58] Field of Search ..... 269/266, 27, 24, 269/267

[56] References Cited

U.S. PATENT DOCUMENTS

| | | | |
|---|---|---|---|
| 2,337,573 | 12/1943 | Schultz | 269/266 |
| 4,752,063 | 6/1988 | Nagy | 269/266 |
| 4,928,938 | 5/1990 | Ross | 269/266 |
| 4,949,947 | 8/1990 | Savoie et al. | 269/266 |
| 5,746,423 | 5/1998 | Arov | 269/267 |

*Primary Examiner*—David A. Scherbel
*Assistant Examiner*—Lee Wilson
*Attorney, Agent, or Firm*—William S. Lovell

[57] ABSTRACT

A vice jig that can accommodate a multiplicity of similarly sized and shaped work pieces provides by a hydraulic piston mechanism an even pressure on all such work pieces upon closure of the vice, in spite of variations in the specific sizes of those work pieces and of the cavities in which the work pieces are held. the invention can accommodate a number of work pieces that is fewer than the number of cavities provided therefor, without there occurring any ejection of any such pistons or of hydraulic fluid.

8 Claims, 2 Drawing Sheets

HYDRAULICALLY COMPENSATING JAW FOR HOLDING MULTIPLE WORK PIECES

BACKGROUNG OF THE INVENTION

Field of the Invention

This invention relates to work shop vices and methods for holding work pieces, and particularly to methods and apparatus for holding at a single time a multiplicity of work pieces having slight size variations that are to be worked upon together.

BACKGROUND INFORMATION

For purposes of carrying out machining, polishing, buffing and other operations on items of metal or plastic or the like, it has long been known to place such a work piece in an ordinary work shop vice so that the piece may be held rigidly in place while the surface of such piece is worked upon. A vice may also be used to hold an item that has already been worked upon, e.g., items that have been glued together may be placed in a vice so as to maintain their fixed relationship while the glue hardens, or an item that has been painted may be held while the paint dries, and so on. Often, however, it is necessary to carry out machining and the other types of operations already mentioned on a large number of such items in sequence, and it then becomes tedious to place each item within a vice, tighten down the vice to hold the item in place, carry out the operation, loosen the vice so as to remove the item, and then replace that item with another similar item for a like operation.

Recognizing the inefficiency of the process just described, it has also long been known to provide a vice that has been adapted to accommodate at once a number of similar work pieces. In lieu of the usual vice that simply has two flat jaws facing one to the other, one of such jaws may be modified to include a number of cavities along the face thereof, said cavities being of a size and shape to accommodate insertion therein of a corresponding number of units of a particular type of work piece. An example of this procedure is shown in FIG. 1, wherein vice jig 10 is seen to comprise a first jaw 12 that has a simple flat surface, and facing thereon a second jaw 14, the side of which that faces onto first jaw 12 having been provided with a number of cavities 16 sized and shaped to accommodate a number of work pieces 18. Such work pieces will then be held in place upon movement of first and second jaws 12, 14 in the directions of arrows 20, 22, respectively.

(For purposes of clarity in the drawing, the top-most cavity 16 in FIG. 1 is shown without an included work piece 18. Also, although the shapes of cavities 16 and work pieces 18 are shown in FIG. 1 to be circular for ease of illustration, those shapes may be rectangular or any other such shape wherein some particular shape of cavity 16 has been designed to accommodate a particular kind of work piece 18.)

For many operations that are relatively undemanding, the apparatus of FIG. 1 as described to this point may serve quite well. However, for carrying out more precise operations such a procedure may be inadequate. For example, in the fabrication of second jaw 14 the precise dimensions of the several cavities 16 may not be identical. The individual dimensions of particular work pieces 18 may likewise not be exactly the same. In that case, the apparatus as described so far will not be able to hold a multiplicity of work pieces 18 under a pressure that is the same for each. Such an effect will come about if the combination of dimensions of cavity 16 and work piece 18 vary too much from one location to another along second jaw 14.

Thus, a particular work piece 18 may be held so loosely that it will become ejected when an attempt is made to work on it. Conversely, a pressure that would adequately hold a smaller work piece 18 within a slightly over-sized cavity 16 might inflict actual physical damage upon a neighboring and slightly larger work piece 18 that happened to have been placed within an under-sized cavity 16. Some means for equalizing the pressure on work pieces 18 of varying sizes that are to be held within cavities 16 that may also vary in sizes is required.

For that purpose, it has long been one practice to approximate such an equalizing effect by placing a strip 24 within vice jig 10 so as to face onto the interior surface of first jaw 12 and onto the facing surfaces of work pieces 18. Strip 24 may variously constitute a piece of leather, rubber, blotting paper, cloth, or any other such flexible material that is also resilient and can serve to assist in holding work pieces 18 under a pressure that may be at least somewhat more equal than would be the case in the absence of strip 24. Such a make-shift procedure can become inconvenient, however, since a worker must somehow manage to hold the several work pieces 18 in place while simultaneously installing strip 24 and closing first and second jaws 12, 14 together. The numerous ways in which strip 24 might happen to have become placed will also render it quite uncertain whether the desired effect of equalizing the strength with which the various work pieces 18 are held will actually have been produced.

With regard to single work pieces, and particularly those that may be irregular in shape, it is known to provide means by which such a piece can be held under essentially constant pressure along the full length thereof. That is, U. S. Pat. No. 1,453,176 issued Apr. 24, 1923 to Perrine describes a compensating jaw which includes a number of rods set in a row and leading through a corresponding number of channels to an elongate cavity containing an enclosed fluid. By virtue of the hydrostatic pressure exerted by such fluid, when such jaw is forced against an object of irregular shape, the respective rods each acquire an extension outwardly from the jaw for which that hydrostatic pressure will be equalized, i.e., the several rods may become extended to different distances in accordance with the shape of the object being held, but the pressure on each rod (and hence the pressure by which the work piece is held at that corresponding point) will be the same. However, no such device seems to have been developed that could accommodate a multiplicity of similar work pieces of varying size. What is needed and would be useful, therefore, is a device that could hold a multiplicity of items under such an equal pressure.

SUMMARY OF THE INVENTION

The invention comprises a method and apparatus for holding a multiplicity of work pieces within mutually facing vice jaws wherein one of such jaws is provided with a multiplicity of cavities for holding a corresponding number of work pieces, and the other jaw includes a corresponding multiplicity of hydraulically-operated pistons, each within a cylinder and each facing on to respective ones of said cavities. These pistons are free to move axially along their respective cylinders in response to an external force that is generated when the jaw is tightened down on a series of work pieces disposed within said cavities, and against a hydrostatic force caused by a fluid contained within a cavity that is disposed inwardly from and communicates with each of said pistons. The effect of such action is to hold each such work piece in place with the same pressure, even though the respective cavities and work pieces may vary in dimensions, one to the other.

Particular types of piston may include on the inward sides thereof a fixed rod of smaller dimension that passes through a correspondingly smaller-sized cylinder. At the interior end of said rods there is placed a malleable seal which, under hydrostatic pressure, is forced transversely against the inner surface of said smaller-sized cylinder, thereby to prevent leakage of fluid past the rod and thence past the piston. A slip ring about the circumference of the rod prevents the piston and rod from being ejected from the device in the event one or more of such cavities happens not to include a work piece.

BRIEF DESCRIPTION OF THE DRAWINGS

The preferred embodiments of the invention will now be described in detail with reference to the accompanying drawings, in which like elements are correspondingly numbered and in which.

DETAILED DESCRIPTION OF THE INVENTION

Figure 2:
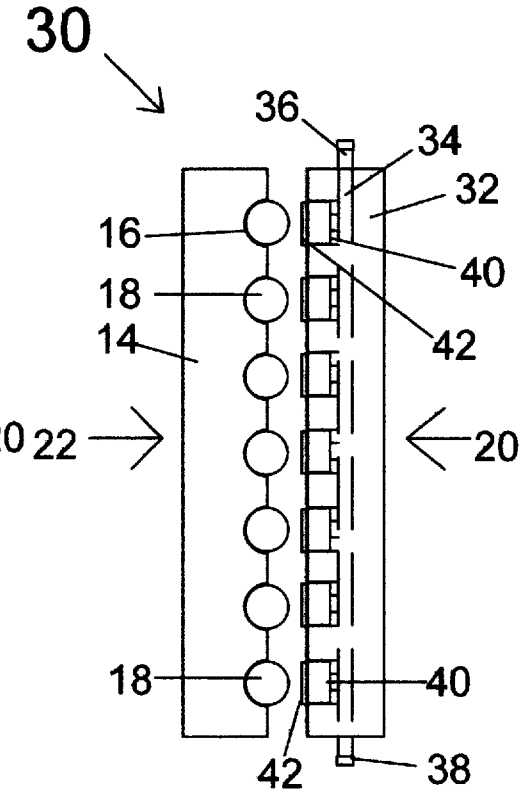
FIG. 2 shows an embodiment of the present invention which holds a multiplicity of work pieces under even pressure by means of a corresponding multiplicity of hydraulically-operated pistons.
Figure 1:
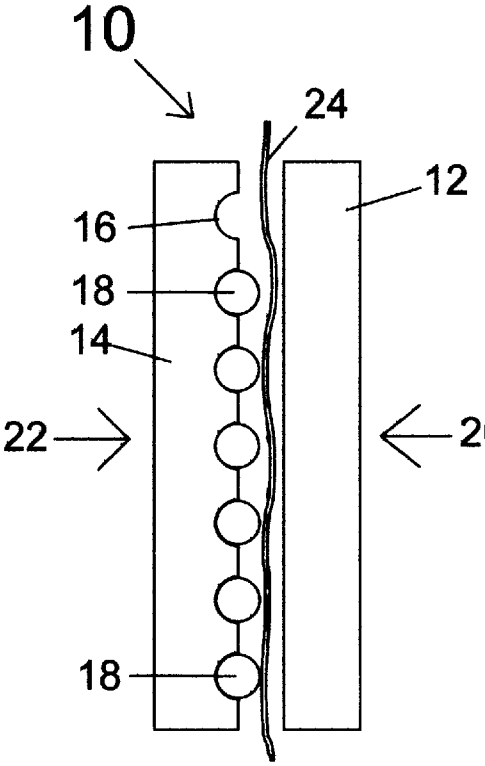
Prior Art Fig. 1
FIG. 1 shows a vice jig from the prior art that is adapted to hold a multiplicity of work pieces under approximately even pressure by use of a resilient sheet.

FIG. 2 shows a vertical plan drawing of a vice jig 30 comprising in the first instance a structure equivalent to second jaw 14 of FIG. 1, including therein cavities 16 and work pieces 18. However, vice jig 30 further comprises a first jaw 32 having a centrally-located fluid chamber 34 extending along the length thereof and extending outwardly therefrom to a distance sufficient to accommodate first and second caps 36, 38 at opposite ends thereof. Along the length of fluid cavity 34 and communicating therewith are a number of hydraulic units 40 from which extend in each case a piston 42 that faces onto corresponding work pieces 18 in second jaw 14. (Optionally, fluid chamber 34 need not extend the full dimension of first jaw 32, but at one end thereof may terminate therewithin, so long as said termination occurs sufficiently outwardly that fluid chamber 34 would still communicate at the end so terminating with the outward-most of hydraulic units 40. In that case only one of caps 36, 38 would be employed, i.e., that at the particular end of fluid chamber 34 that still extended outwardly from first jaw 32 as shown in FIG. 2.)

Figure 3:
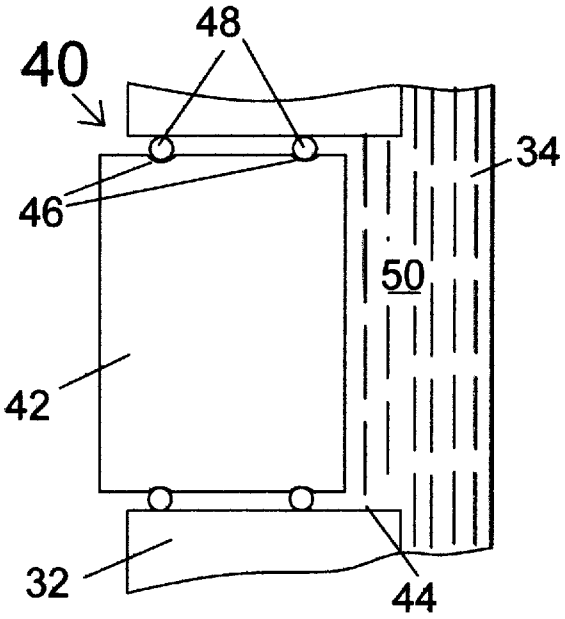
FIG. 3 shows in greater detail a preferred embodiment of the pistons of FIG. 2.

FIG. 3 shows in cross-section an embodiment of hydraulic unit 40 that includes a single disc-shaped piston 42 within cylinder 44. Near to each end of piston 42 is an annular groove 46 adapted to accommodate an annular O-ring 48 to provide containment of fluid 50 within chamber 34 and cylinder 44. Fluid 50, or the fluids in any of the hydraulic unit embodiments to be described hereinafter, may simply be water or any other convenient fluid. In the course of fabricating a vice jig 30 that includes the aforesaid hydraulic unit 40, with one or the other but not both of caps 36, 38 in place the selected number of pistons 42 are placed within respective cylinders 44, and an appropriate amount of fluid 50 is added to chamber 34 so as to fill the same as well as the portions of cylinders 44 that are inward from the inward one of O-rings 48. That one of caps 36, 38 not already in place is then installed by any convenient means so as to fix the amount of contained water and hence the positions of pistons 42. The amount of fluid 50 so added will determine the extent to which pistons 42 extend out of their respective cylinders 44, and since chamber 34 will have been entirely filled, the presence of such fluid will prevent any of pistons 42 from falling out. Again, since all of pistons 42 are in hydraulic communication by virtue of chamber 34 and respective cylinders 44, any inward pressure directed against pistons 42 by work pieces 18 will move pistons 42 into that set of respective positions at which such a pressure is the same on each piston 42, although the axial positions at which such equal pressure actually occurs may vary from one piston 42 to another because of variations in the sizes of cavities 16 and work pieces 18.

Figure 4:
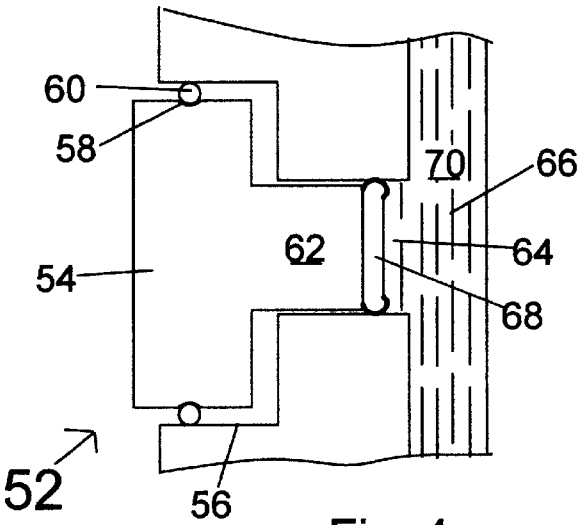
FIG. 4 shows an alternative embodiment of the pistons of FIG. 2, including therein a rod and malleable seal.

Alternatively, as shown in cross-section in FIG. 4, a hydraulic unit 52 may incorporate a thinner piston 54 in a shorter first cylinder 56 using but a single groove 58 containing an annular O-ring 60, said piston 54 further extending at the inner side thereof into a narrower rod 62 that extends further inwardly through a similarly narrow second cylinder 64 into fluid chamber 66. Hydraulic unit 52 further comprises a malleable seal 68, which may be made of heavy rubber or the like, which abuts the inwardly-facing end of rod 62 and faces onto fluid chamber 66. Hydraulic pressure arising from fluid 70 within fluid chamber 66 will act to compress malleable seal 68 against the inwardly-facing end of rod 62, thus causing seal 68 to spread out laterally against the inner walls of second cylinder 64 so as to prevent any of fluid 70 from flowing therepast.

A circumstance not accommodated by hydraulic units 40 or 52 of FIGS. 3 or 4 is that in which one or more cavities 16 do not include a work piece 18, e.g., as was shown for purposes of clarity in the prior art drawing of FIG. 1. In such a case, external pressure on the outwardly facing surfaces of pistons 42 or 54 by adjacent work pieces 18 will create a hydraulic pressure in respective fluids 50 or 70 that will act to expel a piston 42 or 54 that was not similarly subjected to such an external force, i.e., a piston 42 or 50 at a location which contained no work piece 18. A hydraulic unit 72 that prevents such occurrence is shown in cross-section in FIGS. 5A and 5B.

Figure 5A:
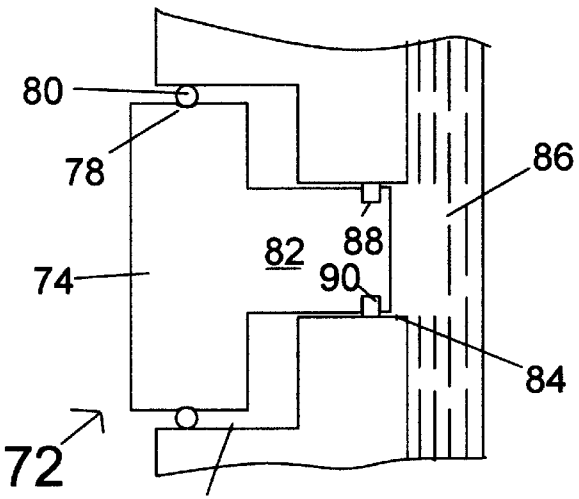
FIG. 5A shows a first step in the installation of a piston-and-rod structure that incorporates a slip ring.

Specifically, hydraulic unit 72 comprises a piston 74 disposed within cylinder 76 and having near the outward side thereof a groove 78 that contains an annular O-ring 80 as before. Also included is a rod 82 that extends inwardly from piston 74 through smaller cylinder 84 towards fluid chamber 86. Near the inward end of rod 82 is disposed an annular ring slot 88 which contains an annular slip ring 90. In the position of piston 74 and rod 82 as shown in FIG. 5A, the outer surface of slip ring 90 abuts the inner wall of smaller cylinder 84, so that axial movement of piston 74 and rod 82 as in the direction of arrow 92 is possible.

Figure 5B:
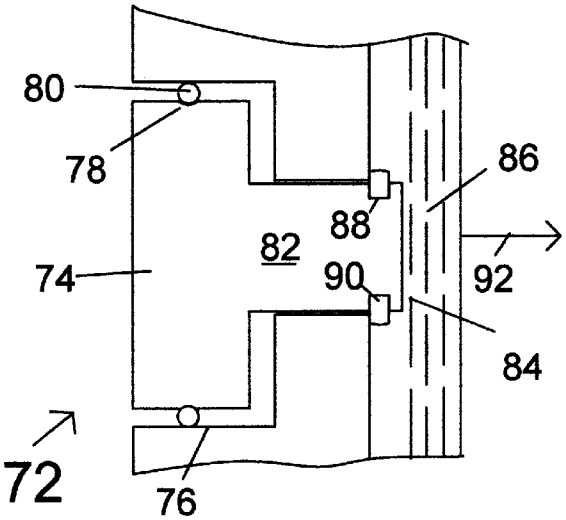
FIG. 5B shows a second, completion step in the installation of a piston-and-rod structure that incorporates a slip ring.

In the position of piston 74 and rod 82 as shown in FIG. 5B, on the other hand, ring slot 88 has been moved past the inner wall of smaller cylinder 84, whereby slip ring 90 has been allowed to expand to a circumference larger than the circumference of smaller cylinder 84. Leftward movement of piston 74 and rod 88 is thus precluded at the point at which the now-expanded slip ring 90 comes into contact with the leftward wall of fluid chamber 86. For that reason, a vice jig which employs hydraulic units of the form of hydraulic unit 72 can be used in those instances wherein fewer work pieces 18 are to be worked upon than the number of cavities 16.

That is, upon application of external pressure to those of hydraulic units 72 that face onto a work piece 18 when the vice is closed together, the resulting internal hydraulic pressure will again force outward those ones of hydraulic units that do not face onto a work piece 18, but only to the point at which such movement is prevented from continuing further by contact between slip rings 90 and the wall of fluid chamber 86. No pistons 74 (nor any fluid) will thereby become ejected from the device, while at the same time the invention will nevertheless carry out its purpose of providing equal pressure to those of work pieces 18 that are in fact present.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof.

I claim:

1. A vice jig comprising:

a first jaw from one side of which face a multiplicity of hydraulically-operated pistons; and a second jaw having on that side of which faces said first jaw a corresponding multiplicity of cavities, each said cavity being adapted to hold a work piece, and wherein said pistons and said cavities are respectively mutually facing.

2. The vice jig of claim 1 wherein each of said multiplicity of pistons is axially moveable within a respective one of a corresponding multiplicity of cylinders.

3. The vice jig of claim 2 further comprising a fluid chamber that is in common hydraulic communication with each of said cylinders.

4. The vice jig of claim 3 wherein said fluid chamber contains a hydraulic fluid.

5. The vice jig of claim 4 further comprising sealing means for preventing loss of hydraulic fluid through said cylinders.

6. The vice jig of claim 4 further comprising lock means for preventing ejection of any of said pistons or any of said fluid upon closure of said vice jig.

7. The vice jig of claim 6 wherein said lock means comprises, in combination:

a multiplicity of ring slots in physical communication with respective ones of said multiplicity of pistons; and a multiplicity of slip rings, each disposed within respective ones of said multiplicity of ring slots.

8. The vice jig of claim 7 wherein said ring slot and slip ring combinations are disposed at locations interior to said first jaw, at positions such that upon minimal inward movement of respective ones of said multiplicity of pistons, corresponding ones of said slip rings will abut interior walls of corresponding ones of said multiplicity of cylinders, while upon sufficient further inward movement of said pistons, said slip rings will become located within said fluid chamber and thereby become able to expand to a diameter larger than that of said cylinders, whereby any subsequent outward movement of said pistons shall be restricted to a fixed distance.

* * * * *